US008793007B2

(12) United States Patent
Philippe et al.

(10) Patent No.: US 8,793,007 B2
(45) Date of Patent: Jul. 29, 2014

(54) VACUUM PUMPING SYSTEMS

(75) Inventors: Laurent Marc Philippe, Gresin (FR); Nigel James Gibbins, Pevensey (GB); Michael Roger Czerniak, Wellington (GB); Michael Mooney, Brighton (GB)

(73) Assignee: Edwards Limited, West Sussex (GB)

( * ) Notice: Subject to any disclaimer, the term of this patent is extended or adjusted under 35 U.S.C. 154(b) by 218 days.

(21) Appl. No.: 12/995,627

(22) PCT Filed: Jun. 2, 2009

(86) PCT No.: PCT/GB2009/050602

§ 371 (c)(1),
(2), (4) Date: Dec. 1, 2010

(87) PCT Pub. No.: WO2009/147426

PCT Pub. Date: Dec. 10, 2009

(65) Prior Publication Data

US 2011/0082580 A1 Apr. 7, 2011

(30) Foreign Application Priority Data

Jun. 2, 2008 (GB) ..... 0809976.4

(51) Int. Cl.
*G06F 19/00* (2011.01)

(52) U.S. Cl.
USPC ..... 700/108; 222/56; 73/168

(58) Field of Classification Search
USPC ..... 700/108; 222/56; 73/168
See application file for complete search history.

(56) References Cited

U.S. PATENT DOCUMENTS

| | | | |
|---|---|---|---|
| 5,332,366 | A | 7/1994 | Anderson |
| 5,718,565 | A | 2/1998 | Kuhn et al. |
| 5,975,857 | A | 11/1999 | Kuhn et al. |
| 6,274,507 | B1 | 8/2001 | Narita et al. |
| 6,364,621 | B1 | 4/2002 | Yamauchi |
| 6,865,513 | B2 | 3/2005 | Ushiku et al. |

(Continued)

FOREIGN PATENT DOCUMENTS

| | | | |
|---|---|---|---|
| DE | 10151682 | A1 | 4/2003 |
| JP | 07208369 | A | 12/1993 |

(Continued)

OTHER PUBLICATIONS

Translation of First Office Action mailed Mar. 27, 2013 in corresponding CN Application No. 200980130694.8, 13 pgs.

(Continued)

*Primary Examiner* — Mohammad Ali
*Assistant Examiner* — Anthony Whittington
(74) *Attorney, Agent, or Firm* — Shumaker & Sieffert, P.A.

(57) ABSTRACT

The present invention relates to a vacuum pumping system (10) which comprises: a vacuum pumping mechanism (12) and a motor (14) for driving the vacuum pumping mechanism. Means (16) are provided for determining a cumulative load on the vacuum pumping system over time by monitoring a characteristic of the motor over that time. Means (18) are also provided for activating a maintenance activity on the system when the cumulative load exceeds a predetermined amount.

29 Claims, 8 Drawing Sheets

(56) References Cited

U.S. PATENT DOCUMENTS

| | | | | |
|---|---|---|---|---|
| 2003/0010792 | A1* | 1/2003 | Forshey et al. | 222/56 |
| 2003/0192920 | A1* | 10/2003 | Forshey et al. | 222/504 |
| 2004/0064212 | A1 | 4/2004 | Samata et al. | |
| 2005/0021301 | A1 | 1/2005 | Dimino et al. | |
| 2005/0167049 | A1* | 8/2005 | Kitazawa | 156/345.26 |
| 2007/0012099 | A1* | 1/2007 | Becourt | 73/168 |
| 2007/0137856 | A1* | 6/2007 | McKinzie et al. | 166/245 |
| 2007/0286737 | A1 | 12/2007 | Johnson | |

FOREIGN PATENT DOCUMENTS

| | | | |
|---|---|---|---|
| JP | 2000064964 | A | 8/1998 |
| WO | 20061098601 | A1 | 10/2006 |
| WO | 2007003862 | A2 | 1/2007 |
| WO | 2007065782 | A1 | 6/2007 |

OTHER PUBLICATIONS

Communication pursuant to Article 94(3) EPC mailed Sep. 12, 2013 in corresponding EP Application No. 09757798.5, 5 pgs.

EPO Communication under R.161(1) and 162 EPC mailed Feb. 24, 2011 in corresponding EP Application No. 09757798.5, 2 pgs.

Response filed Mar. 30, 2011 to the EPO Communication under R.161(1) and 162 EPC mailed Feb. 24, 2011 in corresponding EP Application No. 09757798.5, 6 pgs.

Translation of Second Office Action mailed Jan. 13, 2014 from the State Intellectual Property Office, P.R. China in counterpart CN Application No. 200980130694.8, 3 pgs.

Translation of Notification of Reason for Rejection mailed Nov. 25, 2013 from the Japanese Patent Office in counterpart JP Application No. 2011-512212, 3 pgs.

* cited by examiner

VACUUM PUMPING SYSTEMS

BACKGROUND OF THE INVENTION

The present invention relates to a system comprising a vacuum pumping mechanism and a motor for driving the mechanism.

Hereto, vacuum pumping systems are known which comprise a vacuum pumping mechanism and a motor for driving the mechanism. The pumping system may be connected for exhausting fluid from a processing system for processing wafers, such as semi-conductor wafers, comprising a processing chamber and a transfer chamber. A condition of such a vacuum pumping system deteriorates during operation of the system and a maintenance activity is required to restore, repair or maintain the condition of the system. For instance, a filter may become clogged with particles and require replacement. Previously, such a maintenance activity is scheduled dependent on elapsed time since delivery of the system to a customer or since the performance of a previous maintenance activity. For instance, a maintenance activity may be scheduled for a month after delivery and regularly thereafter. Such a schedule takes no account of the actual requirement for a maintenance activity since a condition of the system may not require maintenance when a maintenance activity is scheduled if for example the system has been operative for less time than was envisaged. Alternatively, and perhaps more dangerously, a condition may require maintenance in advance of a scheduled maintenance activity because the system has been used more extensively than envisaged. It is therefore desirable to perform a maintenance activity on the system according to an actual, real time, requirement of a condition of the system.

It is also known to provide a vacuum pumping sub-system together with other sub-systems in a processing system. An abatement system is one example of such a sub-system. The abatement system treats gas exhausted from vacuum pumping systems to remove hazardous process by-products or other substances from the exhausted gas. In order to remove such substances an abatement system consumes resources such as power, water, gas or other chemicals. If the pumping arrangement is connected for pumping gas from a processing chamber, for instance a processing chamber for processing semi-conductor wafers, the abatement system is activated prior to commencement of a processing procedure and continues to operate at a fixed capacity which is sufficient to treat a maximum expected flow rate of gas from the pumping arrangement. If the abatement system were operated at less than such a fixed capacity some gas may be released into the environment without treatment. It will be appreciated that if the abatement system is set to run at a fixed capacity then there will be redundancy in the system when gas is exhausted from the vacuum pumping system at less than a maximum expected rate or when no gas is exhausted. It is desirable to control the abatement system so that it is operating at a sufficient capacity to treat exhausted gas but without consuming resources unnecessarily.

BRIEF SUMMARY OF THE INVENTION

The present invention provides a vacuum pumping system comprising:

at least one vacuum pumping mechanism;

a motor for driving said at least one vacuum pumping mechanism;

means for determining a cumulative load on said vacuum pumping system over time by monitoring a characteristic of said motor over said time; and means for activating a maintenance activity on said system when said cumulative load exceeds a predetermined amount.

The vacuum pumping system may be adapted for use with a processing system comprising a processing chamber in which wafers can be processed and a transfer chamber through which wafers can be transferred to the processing chamber for processing and transferred from the processing chamber after processing. In this case, the vacuum pumping system may comprise:

a first said vacuum pumping mechanism driven by a first said motor for evacuating gas from the processing chamber; and a second said vacuum pumping mechanism driven by a second said motor for evacuating gas from the transfer chamber;

wherein said determining means determines a cumulative load on said vacuum pumping system over time by monitoring said characteristic of said first motor or said second motor.

The present invention also provides a maintenance detection unit for a vacuum pumping system, said system comprising:

a vacuum pumping mechanism;

a motor for driving said vacuum pumping mechanism; and a system control unit;

wherein said maintenance unit comprises:

means for determining a cumulative load on said vacuum pumping system over time by monitoring a characteristic of said motor;

means for activating a maintenance activity on said system when said cumulative load exceeds a predetermined amount; and an interface for allowing said maintenance detection unit to interface with said control unit so that said determining means can monitor said characteristic.

The present invention also provides a processing system comprising a vacuum pumping sub-system for evacuating gas from a chamber in the system, wherein said vacuum pumping sub-system comprises:

at least one vacuum pumping mechanism; and a motor for driving said at least one vacuum pumping mechanism; and wherein said pumping arrangement comprises:

means for determining a load on said vacuum pumping mechanism by monitoring a characteristic of said motor; and control means for controlling operation of at least one other sub-system in said system in accordance with said determined load on said vacuum pumping mechanism.

The present invention also provides a control unit for a processing system comprising a vacuum pumping sub-system for evacuating gas from a chamber in the system, said vacuum pumping sub-system comprising:

a vacuum pumping mechanism; and a motor for driving said vacuum pumping mechanism;

wherein said control unit comprises:

means for determining a load on said vacuum pumping sub-system by monitoring a characteristic of said motor;

means for controlling operation of at least one other sub-system in said system in accordance with a determined load on said vacuum pumping sub-system.

Other preferred and/or optional aspects of the invention are defined in the accompanying claims.

BRIEF DESCRIPTION OF THE SEVERAL VIEWS OF THE DRAWINGS

In order that the present invention may be well understood, some embodiments thereof, which are given by way of example only, will now be described with reference to the accompanying drawings, in which.

DETAILED DESCRIPTION OF THE INVENTION

Figure 1:
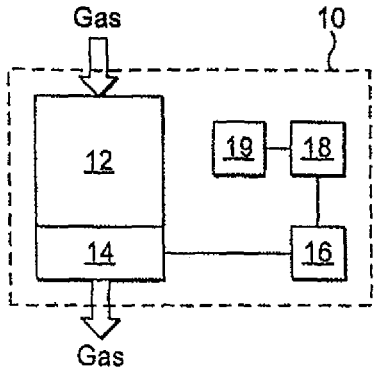
FIG. 1 is a schematic diagram of a vacuum pumping system.

Referring to FIG. 1, a vacuum pumping system 10 is shown which comprises: a vacuum pumping mechanism 12 and a motor 14 for driving the vacuum pumping mechanism. Means 16 are provided for determining a cumulative load on the vacuum pumping system over time by monitoring a characteristic of the motor over that time. Means 18 are also provided for activating a maintenance activity on the system when the cumulative load exceeds a predetermined amount.

Although other characteristics of the motor can be monitored within the scope of the invention, the characteristic of motor 14 which is monitored in FIG. 1 is an electrical power required by the motor to drive the vacuum pumping mechanism 12. Since power equates to the product of electrical potential and current, and the source of electrical potential is generally constant, the determining means 16 can be configured to monitor a current in the coils of the motor in order to determine the power.

In FIG. 1, the cumulative load is equal to the total mass flow of fluid (gas or vapour) pumped by the vacuum pumping mechanism 12 during its operation over a period of time. Accordingly, a condition of the vacuum pumping system 10 which deteriorates in proportion to the mass flow of fluid pumped by the vacuum pumping mechanism can be monitored and when it is deemed appropriate, a maintenance activity can be triggered for restoring the condition of the system. In this way, a condition of the system 10 can be restored when it requires restoration, and not at an arbitrary predetermined moment in time, when the system may or may not require restoration, as is the case with previous vacuum pumping systems. The FIG. 1 arrangement also reduces the possibility of a condition of the system deteriorating to a point at which serious damage occurs, thus avoiding a requirement for expensive repair work or replacement of some or all of the system.

The condition of oil seals, filters, bearings, quality of lubricant are non-exhaustive examples of parts of a vacuum pumping system which deteriorate in proportion to the mass flow of gas through the system.

The activating means 18 receives an output from the determining means 16 relating to the cumulative load on the system. The activating means 18 is configured so that when the cumulative load exceeds a predetermined amount a maintenance activity is triggered. The predetermined amount is selected in accordance with prior experimentation. In this regard, a condition of the system 10 and a cumulative load on the system is monitored by experimental operation of the system and it is noted at what cumulative load the condition of the system requires restoration. Experimentation under various different operating parameters is preferable so that the system can be used in connection with various different processing or scientific equipment. It will be appreciated that different processing and scientific equipment involve the use of different gases, materials, wafers etc which have various different affects on the condition of the vacuum pumping system. Accordingly, the determining means 16 and the activating means can be configured in advance for use with any of a plurality of different apparatus.

Figure 2:
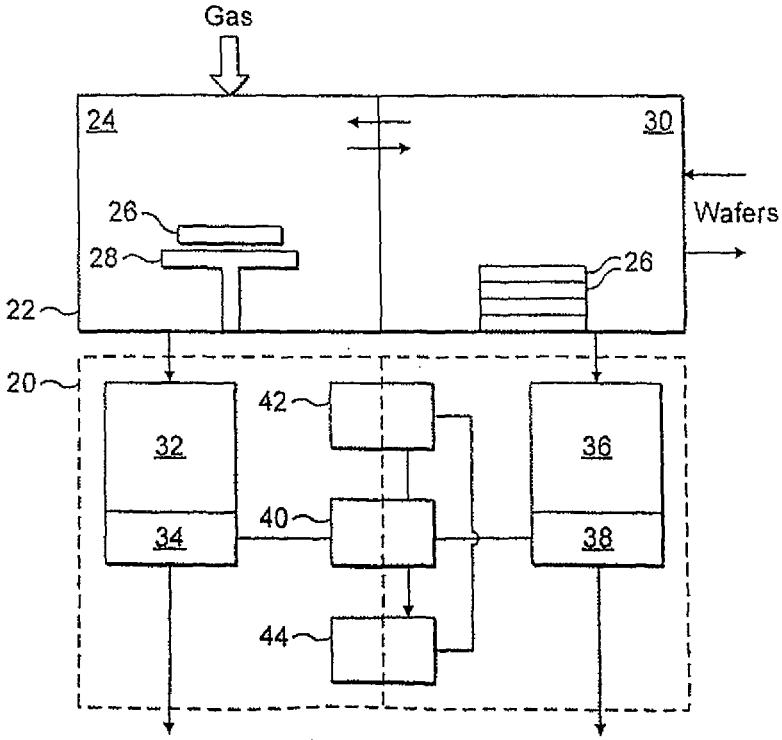
FIG. 2 is a schematic diagram of a second vacuum pumping system and a processing system.

Referring to FIG. 2, a vacuum pumping system 20 is shown for a processing system 22. The processing system 22 comprises a processing chamber 24 in which wafers 26 can be processed on a stage 28 and a transfer chamber 30 through which unprocessed wafers 26 can be transferred to the processing chamber 24 for processing. Processed wafers 26 are transferred from the processing chamber 24 to the transfer chamber 30. The processing chamber 24 is generally maintained at a processing pressure over the course of a plurality of processing cycles during which time wafers are transferred to and removed from the chamber. The transfer chamber 30 on the other hand cycles between a first pressure, which is typically atmosphere, and a processing pressure, which may be several mTorr. Wafers 26 are introduced to the transfer chamber at the first pressure. The pressure in the transfer chamber 30 is reduced to processing pressure and then wafers 26 can be transferred to and from the processing chamber 24. The pressure in the transfer chamber 30 is increased to atmosphere so that processed wafers 26 can be removed.

In this example, the transfer chamber 30 allows two functions to be performed, namely to introduce wafers at atmosphere to the system and to transfer wafers at processing pressure to a processing chamber. In another arrangement, a separate load lock chamber may perform the first of the aforementioned functions and a separate transfer chamber may perform the second of the aforementioned functions. The term transfer chamber herein is intended to cover an arrangement as shown in FIG. 2 or an arrangement in which two separate chambers are provided.

During processing, a processing gas, such as $CF_4$, $C_2F_6$ or $F_2$, is introduced to the processing chamber 24 and evacuated from the chamber by a first vacuum pumping mechanism 32. A first motor 34 drives the first vacuum pumping mechanism. A second vacuum pumping mechanism 36 is driven by a second motor 38 for evacuating gas from the transfer chamber 30.

The gas load on the first vacuum pumping mechanism 32 is dependent on a mass flow of processing gas which is introduced to the processing chamber 24 during a processing step and the power of first motor 23 increases in proportion to the mass flow of gas. Additionally, the mass flow of gas increases when a wafer is processed and therefore fluctuations in the mass flow of gas over time can be used to determine a number of wafers processed by the processing system 22.

The gas load on the second vacuum pumping mechanism 36 cycles between relatively high load during pump down, or a pressure reduction step, of the transfer chamber 30 to processing pressure and relatively low load when the mechanism 36 is not pumping down the chamber. Since a relatively high load occurs once in a processing cycle (i.e. shortly after unprocessed wafers are introduced to the transfer chamber), the cycling of the load on the second vacuum pumping mechanism 36 is a measure of the number of wafers which have been processed by the processing system 22.

Vacuum pumping system 20 comprises determining means 40 which determines a cumulative load on the vacuum pumping system 20 over time by monitoring the characteristic, or in this case the power, of the first motor and/or the second motor. Accordingly, the determining means can determine the number of wafers processed by the processing system either by monitoring a characteristic of the first motor or the second motor. Both the number of wafers processed by the system 22 and the mass flow of gas through the system 20 are indicative of the condition of the vacuum pumping system and can be used together or individually in order to determine its condition.

In more detail, in a first arrangement, the power of the first motor 34 is monitored by the determining means 40 to determine the total mass flow of gas pumped by the first vacuum pumping mechanism 32. In this case, activating means 42 triggers a maintenance activity when the total mass flow of gas exceeds a predetermined total mass flow at which it has been established by prior experimentation that a condition of the vacuum pumping system requires restoration.

In a second arrangement, the power of the first motor 34 is monitored by the determining means 40 to determine the number of wafers processed by system 22. In this case, activating means 42 triggers a maintenance activity when the number of wafers exceeds a predetermined number of wafers at which it has been established by prior experimentation that a condition of the vacuum pumping system requires restoration.

In a third arrangement, the power of the second motor 38 is monitored by the determining means 40 to determine the number of wafers processed by system 22. In this case, activating means 42 triggers a maintenance activity when the number of wafers exceeds a predetermined number of wafers at which it has been established by prior experimentation that a condition of the vacuum pumping system requires restoration.

Any of the first, second, or third arrangements can be adopted individually or more than one of the arrangements can be used in order to provide a more robust indication of the condition of the vacuum pumping system 20.

Figure 3:
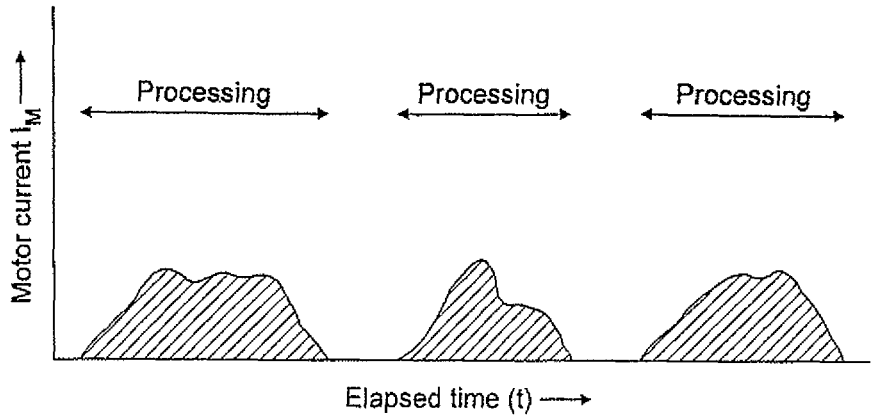
FIG. 3 is a graph showing motor current over elapsed time for a motor of the vacuum pumping system in FIG. 2.

FIG. 3 shows a graph of current ($I_m$) over time (t) through the coils of a first motor 34 shown in FIG. 2. When wafers are processed, processing gas is introduced to the processing chamber 24 and evacuated by vacuum pumping mechanism 32. Evacuation of processing gas increases the load on the mechanism 32 and therefore the current in motor 34 increases. The cumulative load on the system is proportional to an integral of the current with respect to time and accordingly the determining means 40 comprises integrating means for integrating the current with respect to time. If the monitored characteristic is a characteristic other than the current, the determining means 40 comprises means for integrating that other characteristic with respect to time. As shown in FIG. 3 the shaded portion between the curve and the x-axis represents the cumulative gas load on the system. Since deterioration of the system increases with increased cumulative load, the activating means 42 is configured to trigger a maintenance activity when the cumulative gas load exceeds a predetermined amount. Accordingly, a condition of the system can be restored as and when it requires maintenance.

Figure 4:
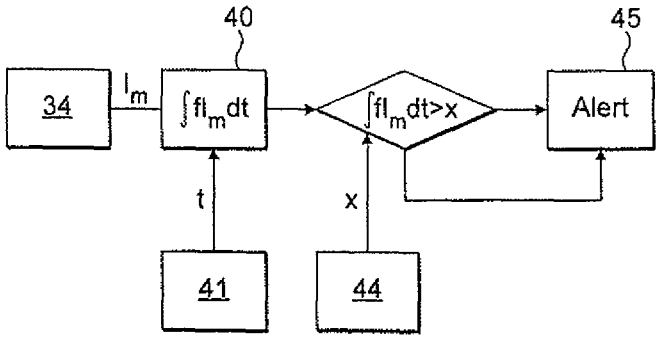
FIG. 4 is a flow diagram of an electronic circuit for the vacuum pumping system shown in FIG. 2.

FIG. 4 shows one example of the determining means and activation means as described above. In FIG. 4, the arrangement is suited for deriving a maintenance requirement from load on pumping mechanism 32, which exhausts gas from processing chamber 24.

As shown in FIG. 3, the load and hence the current $I_m$ increases during processing. The current in motor 34 can be detected directly monitoring the motor or deriving the current from a frequency converter which drives the motor. Determining means 40 comprises a clock circuit 41 and a processing circuit for receiving a time (t) from the clock circuit and a motor current $I_m$. The processing circuit calculates an integral ($\int fI_m dt$) which corresponds to the cumulative load on the system (i.e. the sum of the shaded areas shown in FIG. 3). The activation means 42 comprises a memory 44 for storing a value 'x' determined by experimentation which represents a value of $\int fI_m dt$ above which the system has deteriorated and requires maintenance, for instance an oil filter change. The activation means 42 comprises a comparator for comparing the real time $\int fI_m dt$ with 'x' and outputting a signal SERVICE (e.g. binary '1') if $\int fI_m dt$ is greater than 'x' and NO SERVICE (e.g. binary '0') if $\int fI_m dt$ is less than 'x'. A display 45, or other suitable means of alerting a maintenance activity, displays ALERT in response to a SERVICE signal form the activation means.

Figure 5:
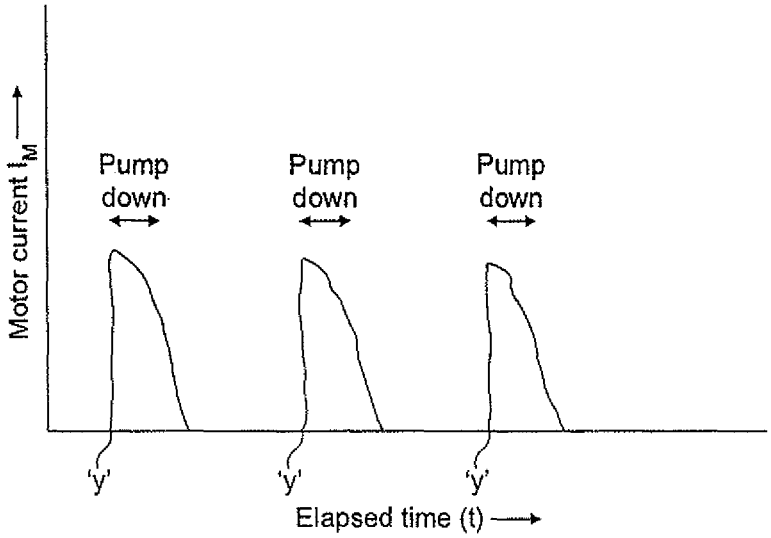
FIG. 5 is a graph showing motor current over elapsed time for the second motor of the vacuum pumping system in FIG. 2.

FIG. 5 shows a graph of current ($I_m$) over time (t) through the coils of a second motor 38 shown in FIG. 2. When wafers are introduced to the transfer chamber 30, the chamber is pumped down by vacuum pumping mechanism 36. Evacuation of gas from the transfer chamber increases the load on the mechanism 36 and therefore the current in motor 38 increases. The processing of each wafer causes deterioration of the vacuum pumping system.

In this regard, a condition associated with the first vacuum pumping mechanism 32 deteriorates in accordance with a total mass flow of processing gas that is pumped. The mass flow of gas pumped by the first vacuum pumping mechanism 32 during processing of each wafer can be determined by experimentation. Also, a condition associated with the second vacuum pumping mechanism 36 deteriorates in accordance with a number of pump downs performed and the number of pump downs required for each wafer or each batch of wafers can be determined by experimentation.

Figure 6:
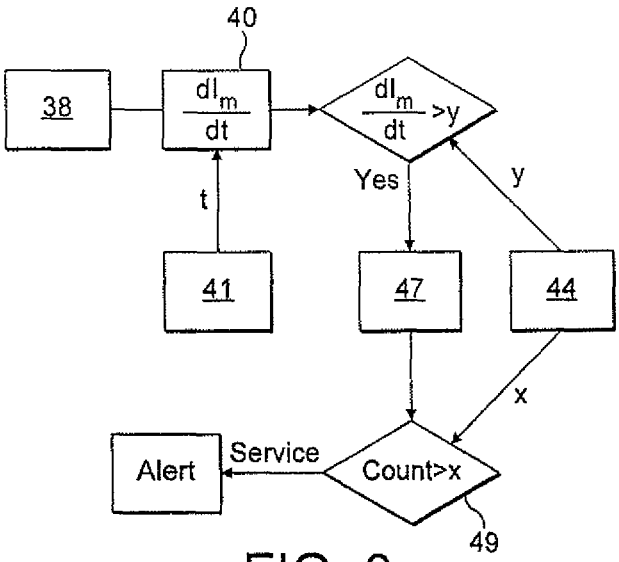
FIG. 6 is a flow diagram of an electronic circuit for the vacuum pumping system shown in FIG. 2.

Referring to FIG. 6, the determining means 40 comprises processing circuitry for differentiating current $I_m$ with respect to time t ($dI_m/dt$). A detected current $I_m$ and a time (t) from a clock circuit 41 is input to the differentiating circuitry. A memory 44 stores a value 'y' which corresponds to $dI_m/dt$ when pumping mechanism 36 commences pump down of the transfer/load lock chamber 30. 'y' is input to a comparator which compares 'y' with $dI_m/dt$ and outputs a YES signal when $dI_m/dt$ is greater than 'y'. The YES signal (e.g. a binary '1') is outputted when a wafer or batch of wafers is loaded into the transfer chamber.

The YES signal is input to a counter 47 which counts the number of wafers or batches loaded into the system and outputs a "Wafer/Batch Count" to a comparator 49. Memory 44 stores a value 'x' which is equal to the number of wafers/batches above which it is determined that a maintenance activity is required. Since each wafer or batch of wafers is indicative of the mass flow processing gas flowing through the system and therefore the deterioration of the system, wafer/batch count is an indicator of system deterioration. Comparator 49 compares Count with 'x' and issues a SERVICE signal (e.g. a binary '1') to a display when the Count is greater than 'x'. The display displays an alert for triggering a maintenance activity.

Referring to FIGS. 3 to 6, the determining means and the activating means can be configured to initiate a maintenance activity according to both the number of wafers and the total mass flow of gas. For instance, a maintenance activity can be triggered if the total gas flow exceeds a predetermined amount but only if the number of wafers processed also exceeds a predetermined amount. Alternatively, a maintenance activity can be triggered if the number of wafers exceeds a predetermined amount but only if the total mass flow of gas also exceeds a predetermined amount.

Referring again to FIG. 1, the vacuum pumping system 10 comprises a user interface 19 which can communicate a requirement for a maintenance activity to a user. The user interface preferably comprises a visual display unit. Alternatively, the interface may comprise any means of alerting a user such as an audible signal or use of a pager. A single interface can be associated with the vacuum pumping mechanism 12 and disposed adjacent thereto. Alternatively, the interface can be disposed remotely from the vacuum pumping mechanism. If the interface is disposed remotely, it can communicate with the activating means over a wired or wireless network. The interface may be configured to communicate with a plurality of activating means so that the interface can indicate a requirement for a maintenance activity of a pumping system comprising a plurality of pumping mechanism or pumps situated away from one another. For instance, the interface can be configured to display a requirement for a maintenance activity of vacuum pumps in many different locations, and accordingly maintenance personnel can be dispatched at appropriate times to restore a condition of any one of the pumps.

The pumping mechanisms described hereinabove may form part of any one of a turbomolecular pump, a booster pump or a backing pump. Alternatively, the pumping mechanism of each of a series of pumps may be monitored. It is currently preferred that the pumping mechanism of the booster pump is monitored.

Figure 7:
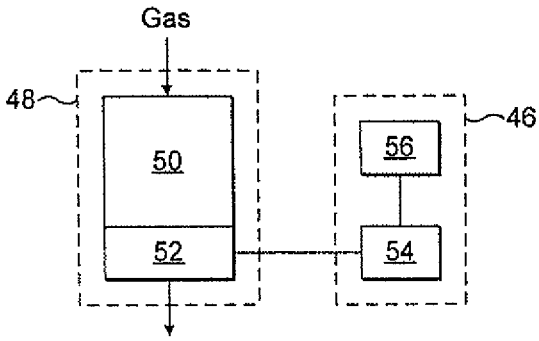
FIG. 7 is schematic diagram of a third vacuum pumping system and a maintenance detection unit.

FIG. 7 shows a maintenance detection unit 46 for a vacuum pumping system 48. The system comprises a vacuum pumping mechanism 50 and a motor 52 for driving the vacuum pumping mechanism. The maintenance unit 46 comprises means 54 for determining a cumulative load on the vacuum pumping system 48 over time by monitoring a characteristic of the motor 52. The unit further comprises means 56 for activating a maintenance activity on the system when the cumulative load exceeds a predetermined amount. The determining means and activating means may be configured as described above with reference to FIGS. 1 to 6. The maintenance detection unit 46 can be fitted to one or more existing pumping systems (i.e. retro-fitted) so that a maintenance activity for restoring a condition of the systems can be triggered according to a monitored characteristic of a motor of the systems.

Typically, an existing pumping system may comprise a control unit fitted thereto which is capable of determining or outputting a characteristic of a motor of the system. In this case, the maintenance detection unit may comprise an interface (not shown) for allowing the maintenance detection unit to interface with the control unit so that said determining means can monitor said characteristic.

Figure 8:
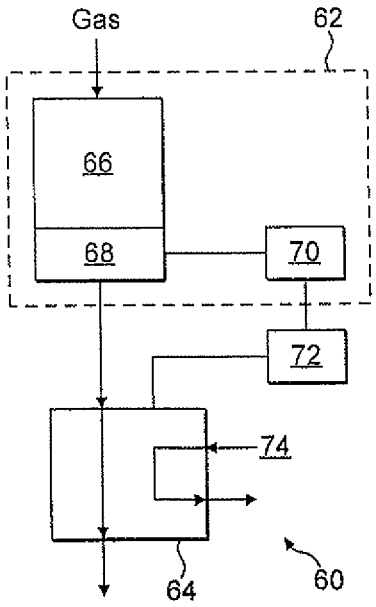
FIG. 8 is schematic diagram of a system comprising a vacuum pumping sub-system and an abatement sub-system.

Referring to FIG. 8, a system 60 is shown which comprises a vacuum pumping sub-system 62 and a further sub-system 64. In FIG. 8, the further vacuum pumping sub-system is an abatement system 64 for treating gas exhausted from the vacuum pumping sub-system.

In other embodiments of the invention, the further sub-system may comprise for example a chiller for chilling a substrate in a processing chamber or a further vacuum pumping sub-system for evacuating gas from a further chamber in the system. In this latter regard, the first vacuum pumping sub-system may be connected for evacuating gas from a load lock chamber and the second vacuum pumping sub-system may be connected for evacuating gas from a processing chamber.

As shown in FIG. 8, the vacuum pumping sub-system 62 comprises: a vacuum pumping mechanism 66 and a motor 68 for driving the vacuum pumping mechanism. The pumping arrangement 60 comprises means 70 for determining a load on the vacuum pumping mechanism 66 by monitoring a characteristic of the motor 68. A control means 72 controls the abatement system 64 in accordance with the determined load on the vacuum pumping mechanism 66. The control means 72 may be configured to control operation of other sub-systems as described above or more than one sub-system.

In the FIG. 8 embodiment, the monitored characteristic is a power required by the motor 68 to drive the vacuum pumping mechanism 66, since the power is in proportion to a load on the vacuum pumping mechanism. It is convenient to configure the determining means 70 so that it can monitor a current in the motor 68 in order to determine the power, as will be described in more detail below with reference to FIGS. 10 and 11.

The load in the example shown in FIG. 8 is the mass flow of fluid (gas or vapour) pumped by the vacuum pumping mechanism 66. In this case, the determining means 70 is configured to determine the mass flow of fluid being pumped by the vacuum pumping mechanism 66 and to output to the control means 72 a signal representative of the determined mass flow rate.

The control means 72 is configured to receive the signal from the determining means 70 and to control the abatement system 64 in accordance with the mass flow rate of gas exhausted from the vacuum pumping system 62.

An abatement system is required to treat exhaust gases if those gases are hazardous or if exhaustion to atmosphere is undesirable or legally restricted. If the vacuum pumping system evacuates gas from a silicon wafer processing system, the gases exhausted may, for example, be $CF_4$, $C_2F_6$ or $F_2$. Gases are treated in a number of different ways and generally the treatment of gases consumes resources 74, such as electrical power, water, oxygen, methane or other gases and chemicals. For instance, exhausted gases may be burnt or cracked in a methane or oxygen flame. The resultant cracked constituents can be dissolved in water to an acceptable concentration, typically or around 3%. The consumption of resources increases expense and the removal of fluorinated water increases expense in accordance with the quantity of such water to be removed.

The abatement system 64 is operated at a capacity which is sufficient to treat the mass flow of gas exhausted from the vacuum pumping system. Hereto, when the vacuum pumping system evacuates gas associated with a given scientific or industrial process, an expected mass flow is determined in advance for such a process and the abatement system is operated at a capacity which is sufficient to treat a maximum expected mass flow of gas which is expected to be generated during the process. The abatement system must be activated for a period prior to commencement of a process and deactivated after a period following termination of the process. The abatement system is operated over this time at full capacity regardless of the amount of gas which is actually exhausted from the vacuum pumping system, for instance if the mass flow of gas exhausted is at 70% of the expected maximum or if during the process no gas is generated. Accordingly, the abatement system must be activated and deactivated manually. Further, the abatement system consumes resources at an unnecessarily high rate during period when a process is generated gases at less than an expected maximum mass flow rate.

Referring to FIG. 8, the determining means 70 determines the mass flow rate exhausted by the vacuum pumping system 62. The control means 72 is configured to control the abatement system so that it operates in idle mode to reduce consumption of resources by the abatement system if the determined mass flow rate is below a threshold for a predetermined duration. The threshold is preferably zero or approaching zero and the duration is preferably set so that the abatement system is put in idle mode when it is reasonably certain that processing has been terminated. Preferably, the abatement system is placed into idle mode once it has been determined that at least twice the duration of a processing cycle time has elapsed.

In one arrangement, the control means 72 comprises a memory for storing expected maximum mass flow rates of gas for a respective plurality of processes. The control means is configured so that if the determined mass flow rate during a given process is at maximum the abatement system is controlled to operate at a capacity which is sufficient to treat the maximum mass flow rate of gas. The control means is further configured so that if the determined mass flow rate of gas is at a percentage less than 100% of the maximum expected mass flow rate, the abatement system is operated at a capacity which is reduced in proportion to the percentage reduction in the mass flow rate. Accordingly, if for instance the mass flow rate of gas is 70% of the expected maximum, the capacity of the abatement system is reduced to 70%.

In another arrangement, the control means is configured so that it operates the abatement system at a capacity which is higher than that required to treat the determined mass flow of gas by a safety margin. The safety margin may be 5% or 10% or any other appropriate margin.

If the further sub-system is a chiller, the control means controls a quantity or temperature of water or other coolant which is circulated. If the further sub-system is a vacuum pumping sub-system, the control means controls operation of the sub-system.

Figure 9:
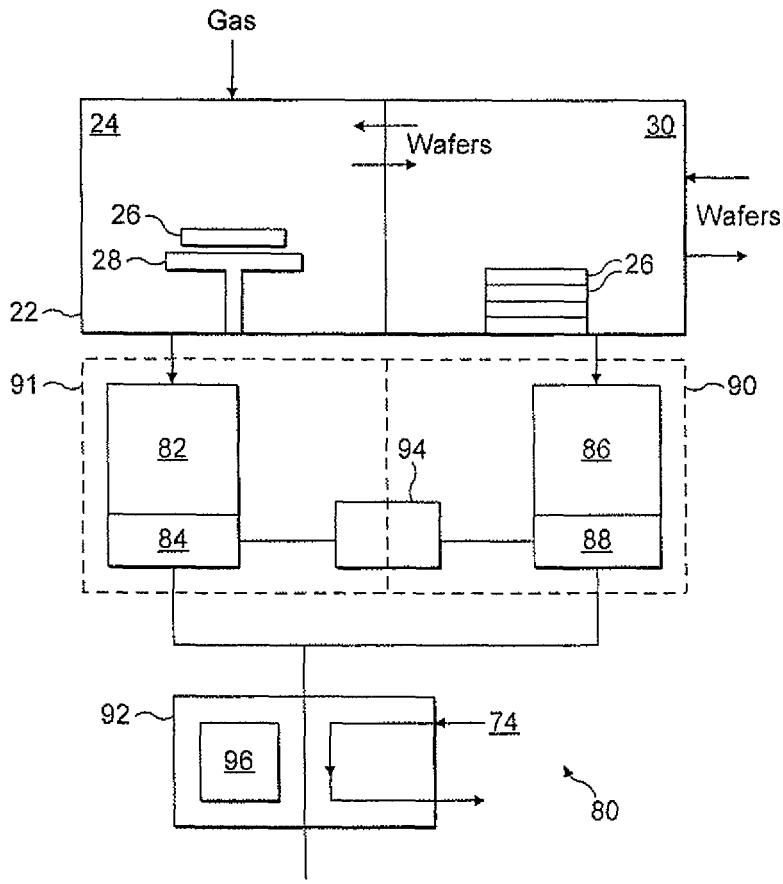
FIG. 9 is a schematic diagram of a processing system comprising a vacuum pumping sub-system and an abatement system.

FIG. 9 shows a processing system 22. The processing system 22 is described in detail above with reference to FIG. 2. A pumping arrangement 80 comprises a first vacuum pumping sub-system 91, a second vacuum pumping sub-system 90 and abatement sub-system 92. The first vacuum pumping sub-system 91 comprises a first vacuum pumping mechanism 82 driven by a first motor for evacuating gas from the processing chamber 24. The second vacuum pumping sub-system 90 comprises a second vacuum pumping mechanism 86 driven by a second motor 88 for evacuating gas from the transfer chamber. Determining means 94 determines a load on the vacuum pumping sub-system 90 by monitoring a characteristic, such as power, of the first motor 84 or the second motor 88.

Determining means 94 is configured in a similar way to the determining means 40 described above with reference to FIG. 2. However, whereas determining means 40 determines a cumulative load on the vacuum pumping system 20 over time, determining means 90 determines a real time load on the vacuum the pumping sub-system 90 and/or sub-system 91.

Accordingly, the determining means can determine when a wafer is being processed or about to be processed by the processing system either by monitoring a characteristic of the first motor and/or the second motor. As the transfer chamber is evacuated at the beginning of a wafer processing cycle, monitoring of the second motor gives advance warning that a further sub-system may be required for use. For instance, the initiation of pump down of a transfer chamber and subsequent transfer of wafers to a processing stage 28 typically takes in the region of a minute depending on the process and the arrangement of apparatus within the system. Accordingly, when the determining means determines that the second pumping mechanism has commenced operation, the control means 96 operates the abatement system so that it is ready to receive processing gases when they are evacuated from the vacuum pumping sub-system 91. Similarly, in another arrangement, control means may commence operation of a chiller for chilling the stage 28 or commence operation of the sub-system 91 for evacuating gas from a processing chamber.

In this way, the abatement system 92 can be activated for treating gas only when gas is or is about to be exhausted from sub-system 91. The determining means can determine the real time mass flow of gas exhausted by the vacuum pumping system by monitoring a characteristic of the motor 88. Therefore, the abatement system can be controlled so that it is operated in idle mode or operative mode thereby conserving resources until they are needed for abatement. Secondly, the determining means can monitor motor 84 so that abatement sub-system 92 can be operated at a capacity which is sufficient to treat the amount of gas being exhausted without unduly consuming excess resources 74.

Figure 10:
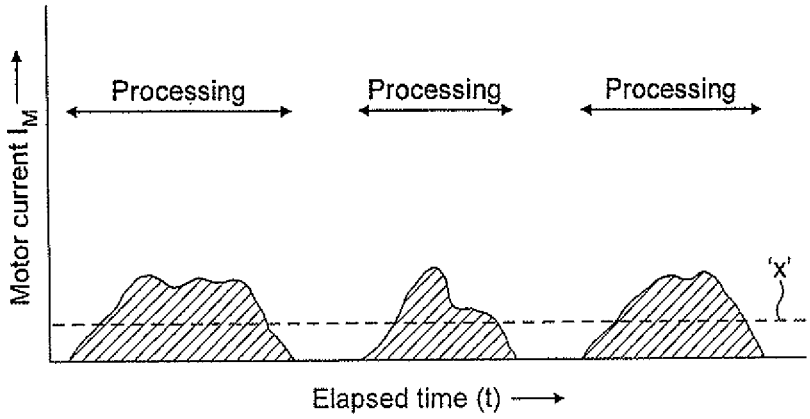
FIG. 10 is a graph showing motor current over elapsed time for a motor of the vacuum pumping sub-system in FIG. 8 or FIG. 9.

FIG. 10, shows a graph of current ($I_m$) over time (t) through the coils of a first motor 84 shown in FIG. 9. When wafers are processed, processing gas is introduced to the processing chamber 24 and evacuated by vacuum pumping mechanism 82. Evacuation of processing gas increases the load on the mechanism 82 and therefore the current in motor 34 increases. The load is proportional to the current and accordingly the determining means 94 comprises current monitoring means for monitoring the current in motor 84. If the monitored characteristic is a characteristic other than the current, the determining means 40 comprises means for monitoring that other characteristic.

Control means 96 controls the abatement system in accordance with the monitored current of the first motor 84 so it is capable of treating the gas exhausted from the vacuum pumping system 90 but without wasting excess resources 74.

Figure 11:
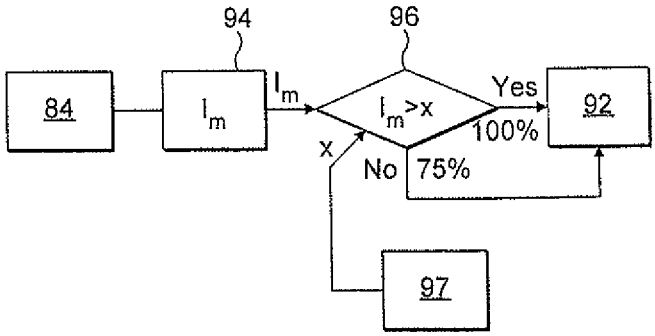
FIG. 11 is a flow diagram of an electronic circuit for the vacuum pumping sub-system shown in FIG. 8 or 9.

FIG. 11 shows one example of the determining means 94 and control means 96 for controlling abatement sub-system 92 to operate at 100% capacity or 75% capacity.

As shown in FIG. 10, a load on the motor 84 and hence the current in the motor ($I_m$) increases during processing. The determining means 94 comprises a detector for detecting current in the motor. The detector may directly monitor motor current or may instead be connected to a frequency converter of the motor. The detector outputs $I_m$ to control 96. The control 96 comprises a current comparator and a memory 97. Memory 97 stores a value 'x' shown in FIG. 10 which is determined by prior experimentation. In this example, it is determined at a current $I_m$ (i.e. load on vacuum sub-system 91) above which the abatement system 92 should be operated at 100% capacity and below which the abatement system should be operated at 75% capacity. The memory may store a plurality of values which have been determined as references for operating the abatement system over a range of capacities (e.g. from 0% to 100%). The current comparator compares the actual current $I_m$ with 'x' and outputs a control signal (e.g. binary '1' for YES and binary '0' for NO) to the abatement system. If $I_m$ is greater than 'x' the output is binary '1' and the abatement system is operated at 100% capacity. If $I_m$ is less than 'x' the output is binary '0' and the abatement system is operated at 75%.

Figure 12:
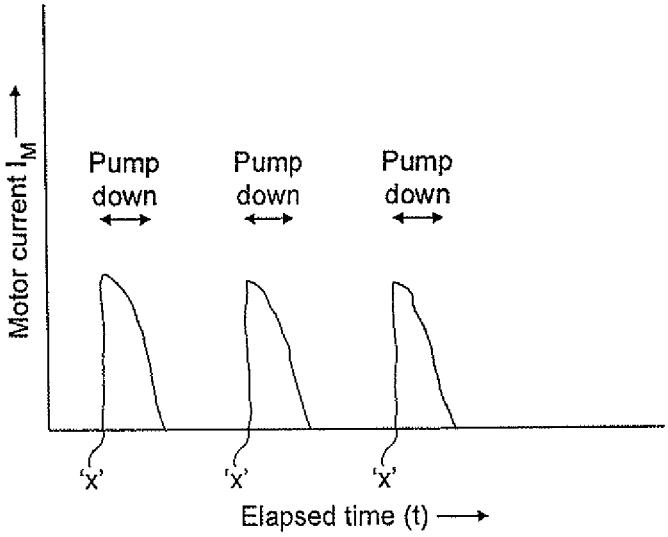
FIG. 12 is a graph showing motor current over elapsed time for the second motor of the vacuum pumping sub-system in FIG. 9.

FIG. 12 shows a graph of current ($I_m$) over time (t) through the coils of a motor 88 shown in FIG. 9. Accordingly, $I_m$ in FIG. 12 corresponds to load on vacuum pumping sub-system 90 which evacuated gas from a load lock/transfer chamber at the beginning of a processing cycle. When wafers are introduced to the transfer chamber 30, the chamber is pumped down by vacuum pumping mechanism 86. Evacuation of gas from the transfer chamber increases the load on the mechanism 36 and therefore the current in motor 38 increases. A processing step for processing wafers commences when the transfer chamber 30 is pumped so it can be predicted therefore that processing gas will be exhausted from the processing chamber at a time after pump down of the transfer chamber 30. Accordingly, the determining means 94 comprises current monitoring means for monitoring the current in the second motor 88 and the control means activates the abatement system so that it is operable to treat gas when gas is exhausted from the vacuum pumping system 90 when processing commences. If gas exhausted from the transfer chamber 30 also requires treatment by the abatement system 92, the control means activates the abatement system when the monitored current in second motor 88 exceeds a threshold.

Figure 13:
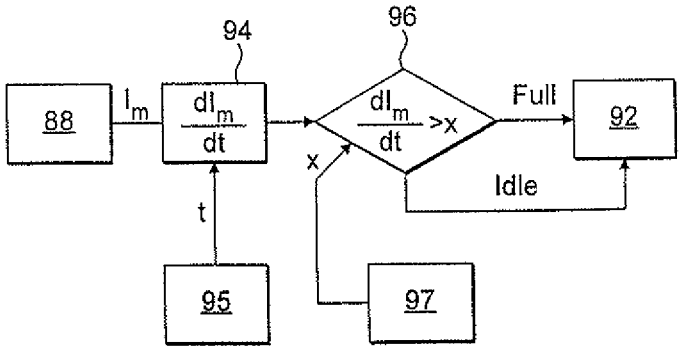
FIG. 13 is a flow diagram of an electronic circuit for the vacuum pumping sub-system shown in FIG. 9.

FIG. 13 shows an example of the determining means 94 and control means 96 for controlling abatement sub-system 92 to operate at idle or full capacity.

As shown in FIG. 12, a load on the motor 88 and hence the current in the motor ($I_m$) increases when pump down of the transfer chamber commences. The determining means 94 comprises a detector for detecting current in the motor. The detector may directly monitor motor current or may instead be connected to a frequency converter of the motor. The determining means 94 in this example comprises a clock circuit 95 and a processor unit for calculating a rate of change of motor current ($dI_m/dt$). The control 96 comprises a comparator for comparing an input rate of change of current with a value 'x' input from memory 97. As shown in FIG. 12, the rate of change of the current $I_m$ occurs at 'x' when the vacuum sub-system 90 commences operation. The comparator compares $dI_m/dt$ with 'x' and outputs a control signal (e.g. binary '1' for FULL and binary '0' for IDLE) to the abatement system 92. If $dI_m/dt$ is greater than 'x' the output is binary '1' and the abatement system is operated at full, or 100%, capacity. If $dI_m/dt$ is less than 'x' the output is binary '0' and the abatement system is operated at idle.

Figure 14:
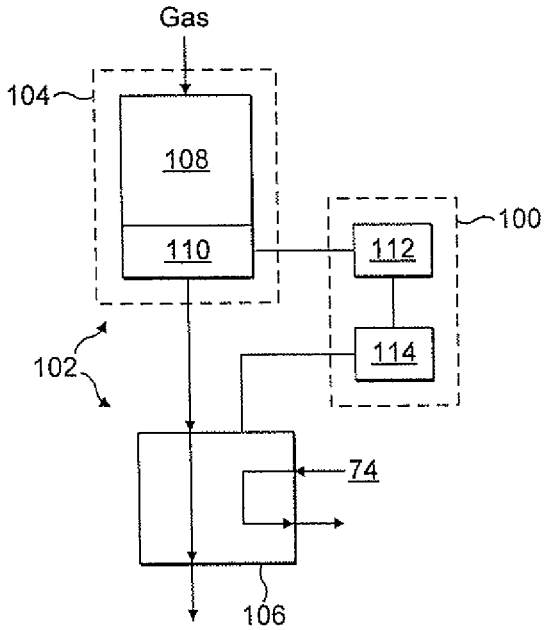
FIG. 14 is a schematic diagram of a control unit for a system as shown in FIGS. 8 to 13.

FIG. 14 shows a control unit 100 which can be retro-fitted to a vacuum pumping system 102 and is similar in operation to the systems described above with reference to FIGS. 8 to 13. The system comprises a vacuum pumping sub-system 104 and an abatement sub-system 106 for treating gas exhausted from the vacuum pumping sub-system 104. The vacuum pumping sub-system comprises a vacuum pumping mechanism 108 and a motor 110 for driving the vacuum pumping mechanism 108. The control unit 100 comprises means 112 for determining a load on the vacuum pumping sub-system 104 by monitoring a characteristic of the motor 110. The unit further comprises means 114 for controlling the abatement system 106 in accordance with the monitored load on the vacuum pumping sub-system. The determining means 112 and control means 114 may be configured as described above with reference to FIGS. 8 to 13. The control unit 100 can be fitted to one or more existing vacuum pumping arrangements so that the abatement systems of such existing systems can be controlled to avoid wasting excessive resources 74 in accordance with a monitored characteristic of the motor 110.

The apparatus described in FIGS. 1 to 7 allow cumulative load on a system to be monitored and maintenance of the system to be carried out accordingly. The apparatus described in FIGS. 8 to 14 allow load on a vacuum sub-system to be monitored and other sub-systems to be controlled accordingly. The determining means and activation means described in FIGS. 1 to 7 can be integral with the determining means and control means, respectively, described in FIGS. 8 to 14. Integration in this way provides apparatus for activating maintenance and controlling sub-systems in accordance with a characteristic of the motor of a vacuum pump.

The invention claimed is:

1. A vacuum pumping system for a processing system comprising a processing chamber configured to process wafers and a transfer chamber configured to accept wafers being transferred to the processing chamber for processing and being transferred from the processing chamber after processing, the vacuum pumping system comprising:

a first motor;

a second motor;

a first vacuum pumping mechanism driven by the first motor for evacuating gas from the processing chamber;

a second vacuum pumping mechanism driven by the second motor for evacuating gas from the transfer chamber;

means for determining a cumulative load on the vacuum pumping system over time by monitoring a characteristic of the first motor or the second motor over the time; and means for activating a maintenance activity on the vacuum pumping system when the cumulative load exceeds a predetermined amount.

2. The vacuum pumping system of claim 1, wherein the characteristic comprises a power required by the first motor to drive the first vacuum pumping mechanism or a power required by the second motor to drive the second vacuum pumping mechanism.

3. The vacuum pumping system of claim 2, wherein the means for determining monitors a current in the first motor in order to determine the power required by the first motor or monitors a current in the second motor in order to determine the power required by the second motor.

4. The vacuum pumping system of claim 1, wherein the cumulative load is equal to the total mass flow of fluid pumped by the first vacuum pumping mechanism or the second vacuum pumping mechanism during the time.

5. The vacuum pumping system of claim 4, wherein a condition of the vacuum pumping system deteriorates in proportion to the mass flow of fluid pumped by the first vacuum pumping mechanism or the second vacuum pumping mechanism, and wherein the predetermined amount is predetermined such that when the cumulative load exceeds the predetermined amount the pumping system requires a maintenance activity to be performed in order to restore the condition.

6. The vacuum pumping system of claim 1, wherein the means for determining monitors the characteristic of the second motor over the time;

wherein during pump down the second vacuum pumping mechanism reduces the pressure in the transfer chamber from a first pressure at which wafers are introduced to the transfer chamber to a second pressure at which wafers are transferred from the transfer chamber to the processing chamber for processing;

wherein the characteristic of the second motor increases during pump down and decreases when the second vacuum pumping mechanism is not reducing pressure in the transfer chamber; and wherein the cumulative load is a number of wafers processed by the processing system and the means for determining means determines the cumulative load by counting a number of increases in the characteristic of the second motor.

7. The vacuum pumping system of claim 1, wherein the means for determining monitors the characteristic of the first motor over the time;

wherein the first vacuum pumping mechanism introduces processing gas to the processing chamber during a processing step and evacuates processing gas from the processing chamber;

wherein the characteristic of the first motor increases during each processing step and decreases when the first vacuum pumping mechanism is not evacuating gas from the processing chamber; and wherein the cumulative load is equal to the total mass flow of processing gas pumped by the first vacuum pumping mechanism over a plurality of processing steps and the means for determining determines the cumulative load by determining an amount by which the characteristic of the first motor increases over time.

8. The vacuum pumping system of claim 7, wherein the cumulative load is proportional to an integral of the characteristic with respect to time and the means for determining comprises integrating means for integrating the characteristic with respect to time.

9. The vacuum pumping system of claim 6, wherein a condition of the vacuum pumping system associated with at least one of the first vacuum pumping mechanism and the second vacuum pumping mechanism deteriorates in proportion to a number of wafers processed by the processing system; and wherein the means for activating triggers the maintenance activity for restoring the condition when the number of wafers processed by the system exceeds a predetermined amount.

10. The vacuum pumping system of claim 7, wherein a condition of the vacuum pumping system associated with at least one of the first vacuum pumping mechanism and the second vacuum pumping mechanism deteriorates in proportion to a total mass flow of processing gas evacuated by the first vacuum pumping means from the processing chamber; and wherein the means for activating triggers the maintenance activity for improving the condition when the total mass flow of processing gas exceeds a predetermined amount.

11. The vacuum pumping system of claim 9, wherein the condition of the vacuum pumping system associated with the at least one of the first vacuum pumping mechanism or the second vacuum pumping mechanism deteriorates according to the cumulative load as a function of a number of wafers processed by the processing system and a total mass flow of processing gas evacuated by the first vacuum pumping mechanism from the processing chamber; and wherein the means for activating triggers the maintenance activity for improving the condition when the cumulative load exceeds the predetermined amount.

12. The vacuum pumping system of claim 11, wherein the means for determining determines the cumulative load as function of the number of wafers adjusted by the total mass flow of gas.

13. The vacuum pumping system of claim 1, further comprising:

a user interface disposed remotely from the first vacuum pumping mechanism and the second vacuum pumping mechanism, the system being arranged such that the means for activating outputs a requirement for the maintenance activity at the user interface.

14. The vacuum pumping system of claim 1, further comprising a booster pump, wherein the booster pump comprises at least one of the first vacuum pumping mechanism and the second vacuum pumping mechanism.

15. A maintenance detection unit for a vacuum pumping system for a processing system comprising a processing chamber configured to process wafers and a transfer chamber configured to accept wafers being transferred to the processing chamber for processing and being transferred from the processing chamber after processing, the vacuum pumping system comprising a first motor; a second motor; a first vacuum pumping mechanism driven by the first motor for evacuating gas from the processing chamber; and a second vacuum pumping mechanism driven by the second motor for evacuating gas from the transfer chamber; the maintenance detection unit comprising:

means for determining a cumulative load on the vacuum pumping system over time by monitoring a characteristic of the first motor or the second motor over the time;

means for activating a maintenance activity on the vacuum pumping system when the cumulative load exceeds a predetermined amount; and an interface for between the maintenance detection unit and the vacuum pumping system control unit.

16. A processing system comprising:

a processing chamber configured for containing wafers during processing;

a transfer chamber configured to accept wafers being transferred to the processing chamber for processing and being transferred from the processing chamber after processing;

a vacuum pumping sub-system comprising:

a first motor;

a second motor;

a first vacuum pumping mechanism driven by the first motor for evacuating gas from the processing chamber;

a second vacuum pumping mechanism driven by the second motor for evacuating gas from the transfer chamber;

at least one other sub-system in addition to the vacuum pumping sub-system;

means for determining a load on the vacuum pumping sub-system by monitoring a characteristic of the first motor or the second motor; and control means for controlling operation of the at least one other sub-system in accordance with the load on the vacuum pumping sub-system.

17. The processing system of claim 16, wherein the characteristic comprises a power required by the first motor to drive the first vacuum pumping mechanism or a power required by the second motor to drive the second vacuum pumping mechanism, the power being in proportion to a load on the first vacuum pumping mechanism or the second vacuum pumping mechanism.

18. The processing system of claim 17, wherein the means for determining monitors a current in the first motor in order to determine the power required by the first motor or monitors a current in the second motor in order to determine the power required by the second motor.

19. The processing system of claim 16, wherein the load comprises the mass flow of fluid pumped by the first vacuum pumping mechanism or the second vacuum pumping mechanism.

20. The processing system of claim 19, wherein the means for determining determines the mass flow of fluid being pumped by the vacuum pumping mechanism or the second vacuum pumping mechanism and outputs, to the control means for controlling operation of the at least one other sub-system, a signal representative of the mass flow rate.

21. The processing system of claim 20, wherein the control means for controlling operation of the at least one other sub-system controls operation of the at least one other sub-system in accordance with the flow rate of fluid.

22. The processing system of claim 21, wherein the control means for controlling operation of the at least one other sub-system controls the at least one other sub-system to operate in idle mode to reduce consumption of resources by the at least one other sub-system when the mass flow rate of fluid is below a threshold mass flow rate of fluid for a predetermined duration.

23. The processing system of claim 16, wherein the control means for controlling operation of the at least one other sub-system activates operation of the at least one other sub-system when the load increases above a threshold load.

24. The processing system of claim 16, wherein the transfer chamber comprises a load lock chamber.

25. The processing system of claim 16, wherein the at least one other sub-system comprises at least one of an abatement system, a chiller, or a second vacuum pumping sub-system.

26. The processing system of claim 16, wherein the means for determining comprises a clock and differentiating circuitry and the control means comprises a comparator and a memory.

27. A processing system comprising:

an abatement system;

a processing chamber;

a load lock chamber;

a vacuum pumping sub-system comprising:

a first vacuum pumping mechanism driven by a first motor for evacuating gas from the processing chamber; and a second vacuum pumping mechanism driven by a second motor for evacuating gas from the load lock chamber, wherein in a pressure reduction step the second vacuum pumping mechanism reduces the pressure in the load lock chamber from a first pressure at which wafers are introduced to the transfer chamber to a second pressure at which wafers are transferred from the transfer chamber to the processing chamber for processing;

determining means for determining a load on the vacuum pumping sub-systems by monitoring a characteristic of the second motor, wherein the characteristic of the second motor increases during each pressure reduction step and decreases when the second vacuum pumping mechanism is not reducing pressure in the transfer chamber; and control means for activating the abatement system when the characteristic increases above a threshold and causing the abatement system to adopt an idle mode when the characteristic has decreased below the threshold for a predetermined duration.

28. The processing system of claim 27, wherein the first vacuum pumping mechanism introduces processing gas to the processing chamber during a processing step and evacuates processing gas from the processing chamber.

29. A control unit for a processing system comprising a processing chamber configured to process wafers, a transfer chamber configured to accept wafers being transferred to the processing chamber for processing and being transferred from the processing chamber after processing, and a vacuum pumping sub-system, wherein the vacuum bumping sub-system comprises a first motor, a second motor, a first vacuum pumping mechanism driven by the first motor for evacuating gas from the processing chamber, a second vacuum pumping mechanism driven by the second motor for evacuating gas from the transfer chamber, the processing system further comprising at least one other sub-system in addition to the vacuum pumping sub-system, the control unit comprising:

means for determining a cumulative load on the vacuum pumping sub-system over time by monitoring a characteristic of the first motor or the second motor over the time; and means for controlling operation of the at least one other sub-system in accordance with the cumulative load on the vacuum pumping sub-system.

* * * * *

UNITED STATES PATENT AND TRADEMARK OFFICE

CERTIFICATE OF CORRECTION

PATENT NO. : 8,793,007 B2
APPLICATION NO. : 12/995627
DATED : July 29, 2014
INVENTOR(S) : Philippe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 394 days.

Signed and Sealed this
Fifteenth Day of September, 2015

Michelle K. Lee

Michelle K. Lee
*Director of the United States Patent and Trademark Office*